US005795184A

United States Patent [19]

Pan et al.

[11] Patent Number: 5,795,184

[45] Date of Patent: Aug. 18, 1998

[54] DEVICE FOR INTERCONNECTING STACKED CONNECTORS AND BOARD

[75] Inventors: Hua-Tseng Pan; Chu-Mei Chen, both of Taipei; Ming-Yow Hon, Taipei Hsien, all of Taiwan

[73] Assignee: Hon Hai Precision Ind. Co., Ltd., Taipei Hsien, Taiwan

[21] Appl. No.: 646,915

[22] Filed: May 8, 1996

[51] Int. Cl.[6] ..... H01R 13/60

[52] U.S. Cl. ..... 439/541.5; 439/64

[58] Field of Search ..... 439/541.5, 64, 439/540, 79, 65, 159, 157, 160

[56] References Cited

U.S. PATENT DOCUMENTS 5,399,105 3/1995 Kaufman et al. ..... 439/541.5

5,601,438 2/1997 Ho et al. ..... 439/541.5

*Primary Examiner*—Khiem Nguyen
*Assistant Examiner*—Eugene G. Byrd

[57] ABSTRACT

An interface device (24) includes a plurality of passageways (30) extending therethrough for receiving therein a corresponding number of conductors (100) wherein all of the tails (102) of the conductors (100) extend outward to be exposed to an open exterior for easy access for examination or rework. The passageways of the interface device (24) are adapted to receive the contact tails (16) of both of the stacked memory card connectors (12, 14). The conductors (100) of device (24) are arranged to have two-row conductors (100) become one-row tail (102) extending outward on one side of the housing (26) of the device (24) whereby through the interface device (24), the stacked memory card connectors (10) can be electrically engaged therewith for electrically connecting to the mother board (200).

13 Claims, 11 Drawing Sheets

DEVICE FOR INTERCONNECTING STACKED CONNECTORS AND BOARD

BACKGROUND OF THE INVENTION

1. Field of The Invention

The invention relates to devices for electrically connecting stacked connectors and the board on which such stacked connectors are mounted, and particularly for electrically connecting both the upper and lower connectors to the board below.

2. The Prior Art

In the recent years, it is popular that the stacked type connector assembly has been used for efficiently increasing the memory capacity in the computer system without increasing too much space thereof. One concern has been taken that how contact tails of the upper level connector can be accurately mountably soldered on the mother board on which such stacked type connector assembly is seated. U.S. Pat. Nos. 5,286,207 and 5,364,275 respectively taught using a socket and a flexible printed circuit (FPC) board to connect the contacts of the upper connector to the mother board on which such stacked memory card connector assembly is seated. Additionally, generally speaking, because it is easy to inadvertently solder the contact tails onto the corresponding pads on the mother board in an imperfect manner and naturally it is successively required to rework on or replace it. Therefore, if the relative expensive memory card connectors are directly soldered onto the mother board and unfortunately a bad soldering is brought about, it can not help but have such expensive memory card connector taken from the mother board and discarded. It is not economic way for a computer manufacture. Thus, as shown in FIG. 1, recently it is desired to have a pair of inexpensive socket 1 and 1' already mounted on the mother board 2, and the stacked upper and lower memory card connectors 3 and 4 are assembled to the mother board 2 by fastening means like screws, wherein the contact tails 5 of the contacts 6 of the upper and the lower connector 3 and 4 are respectively engaged with the terminals or conductors in the socket 1 and 1' for indirectly electrical connection to the mother board 2. Under this situation, it only needs to replace or rework the mis-soldered inexpensive socket, if any exists, instead of having the whole expensive memory card connector discarded for such undesired defective situation, i.e., imperfect soldering between on the mother board 2. In other words, the expensive memory card connectors can be easily assembled to the mother board 2 only by mechanical screwing securement and electrical engagement with the socket already mounted on the board, thus assuring no relatively high cost waste of the memory card connectors for any imperfect soldering problem.

It can be seen that the terminal tails 7', which are located on the outer side of the socket 1 and 1', are easily investigated and worked, but the terminal tails 7", which are located on the inner side of the socket 1 and 1", i.e., the area between these two sockets 1 and 1", are substantially with difficulty examined. Therefore, an object of the invention is to provide an electrical device easily and already electrically mounted on the mother board for mating with a counterpart connector assembly which generally includes a pair of connectors stacked together.

SUMMARY OF THE INVENTION

According to an aspect of the invention, an interface device includes a plurality of passageways extending therethrough for receiving therein a corresponding number of conductors wherein all of the tails of the conductors extend outward to be exposed to an open exterior for easy access for examination or rework. The passageways of the interface device are adapted to receive the contact tails of both of the stacked memory card connectors. The conductors of device are arranged to have two-row conductors become one-row tail extending outward on one side of the housing of the device whereby through the interface device, the stacked memory card connectors can be electrically engaged therewith for electrically connecting to the mother board.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
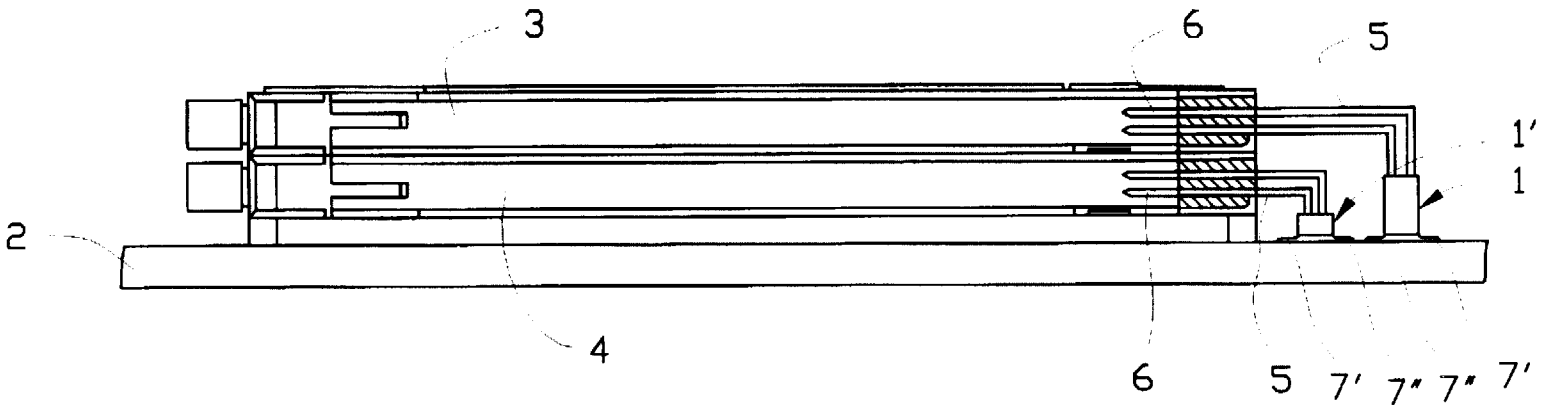
FIG.1 (PRIOR ART)
FIG. 1 is a partially cross-sectional view of the interface device for use with a stacked memory card connector assembly of the prior art.
Figure 2:
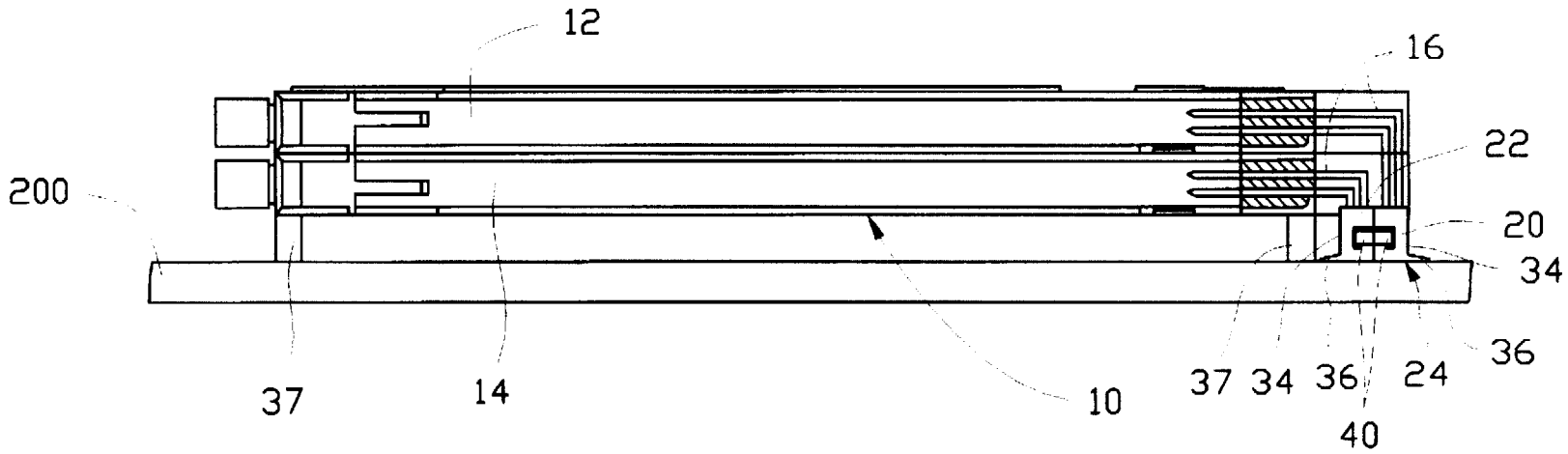
FIG. 2 is a partially cross-sectional view of an interface device for use with a stacked memory card connector assembly according to the invention.
Figure 3:
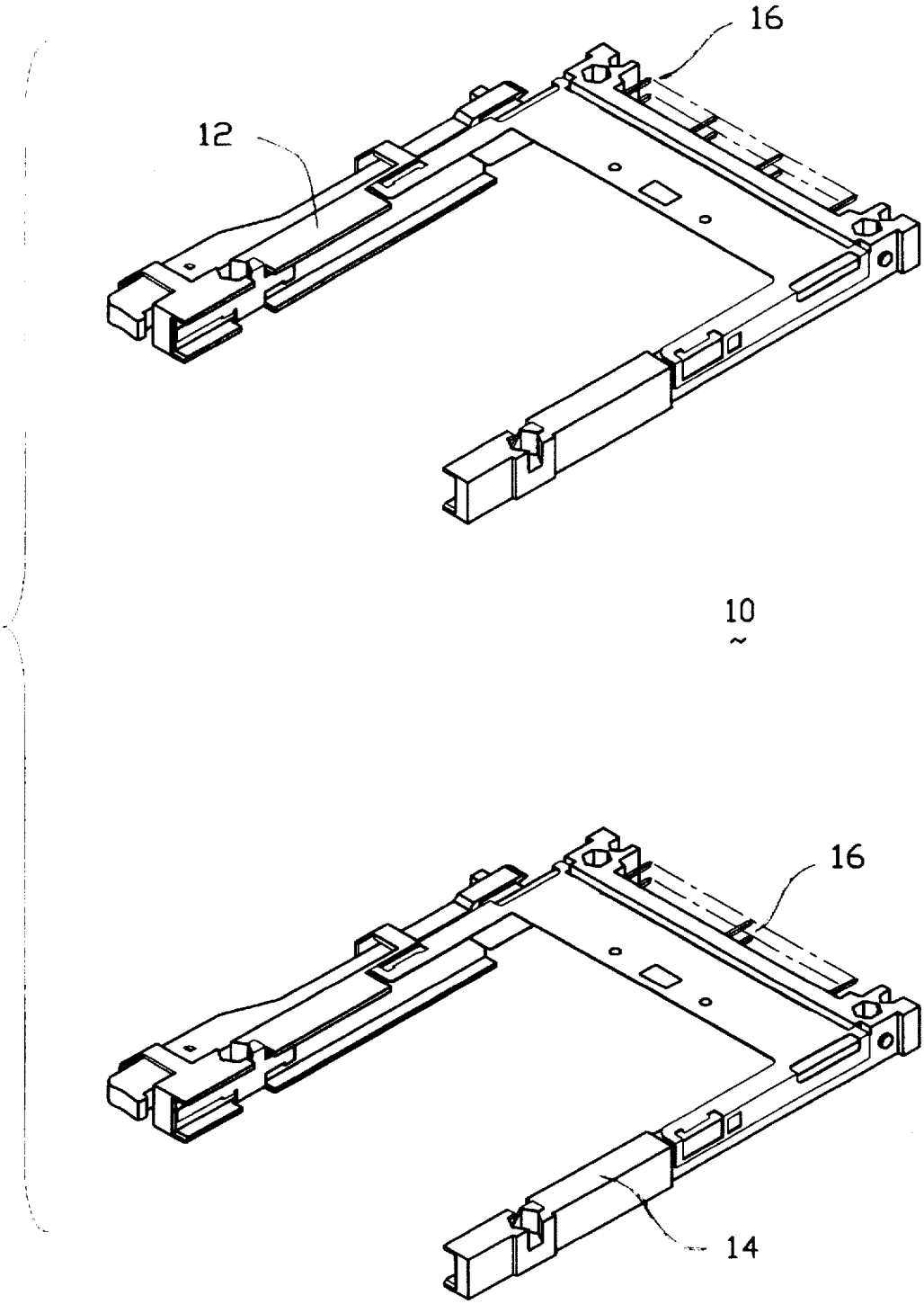
FIG. 3 is a perspective view of a separate upper memory card connector and a separate lower memory card connector both of which are adapted to be stacked together as shown in FIG. 2.
Figure 4:
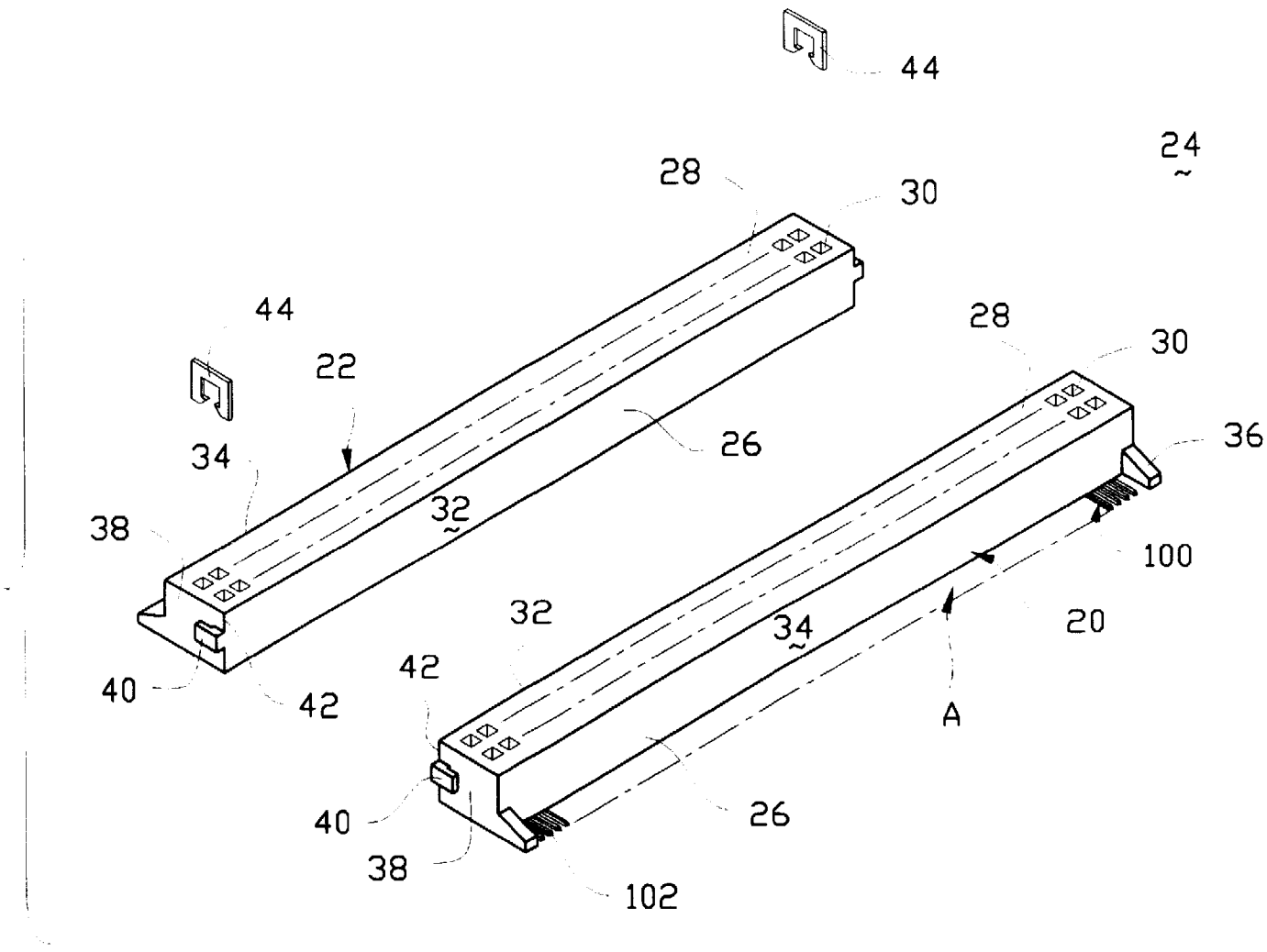
FIG. 4 is an exploded perspective view of the interface device of FIG. 2.

It will be noted here that for a better understanding, most of like components are designated by like reference numerals throughout the various figures in the embodiments. Attention is directed to FIGS. 2–4 wherein the stacked memory card connector assembly 10 includes an upper connector 12 and a lower connector 14 closely stacked with each other in a vertical direction. The contact tails 16 of the upper connector 12 and the contact tails 16 of the lower connector 14 are respectively received within a first half section 20 and a second half section 22 of an subject interface device 24.

Referring to FIG. 4, the subject interface device 24 includes a first half section 20 and a generally identical second half section 22 wherein the first half section 20 and the second half section 22 are arranged in a symmetric manner when they are face-to-face fastened together. Each half section 20, 22 includes an insulative housing 26 defining a top surface 28 having a plurality of passageways 30 extending downward therefrom and to the opposite bottom surface (not shown) for receiving therein a corresponding number of conductors 100 which will be described in detail later.

Each housing 26 further defines an abutting surface 32 facing to that of another opposite housing 26. An exterior surface 34 faces to an exterior and a pair of supporting piers 36 respectively project laterally at two opposite ends thereof so as to define a conductor tail region A therebetween whereby the conductor tails 102 of such specific housing 26 are totally arranged to extend outward from the exterior surface 34 and located within such region A.

The housing 26 further includes a pair of end surfaces 38 in the lengthwise direction. Each end surface 38 includes half a locking bar 40 adjacent the edge 42 so that when these two half sections 20 and 22 face-to-face confront with each other with their abutting surfaces 32 and are securely assembled together by means of a U-shaped clip 44 incorporating each pair of half locking bars 40.

As mentioned earlier, the first half section 20 is adapted to receive the contact tails 16 of the upper connector 12 for mating with the conductor 100 therein, and the second half section 22 is adapted to receive the contact tails 16 of the lower connector 14 for mating the conductor 100 therein. Therefore, the signals of the upper connector 12 can be transferred to the mother board 200 through the conductor tails 102 of the first half section 20, and the signals of the lower connector 14 can be transferred to the mother board 200 through the conductor tails 102 of the second half section 22.

One feature of the invention is that in each half section 20, 22, two rows conductors 100 are both bent toward the exterior surface 34 and extend far away from the abutting surface 32 so that such pair of first and second half sections 20, 22 can be tightly secured to each other by their abutting surfaces 32 facing to each other without any obstacles due to conductor tails 102.

Another feature of the invention is that the standoffs 37 are provided with the bottom portion of the stacked memory card connector assembly 10 for compliance with the height of the interface device 24 located thereabouts.

Figure 5:
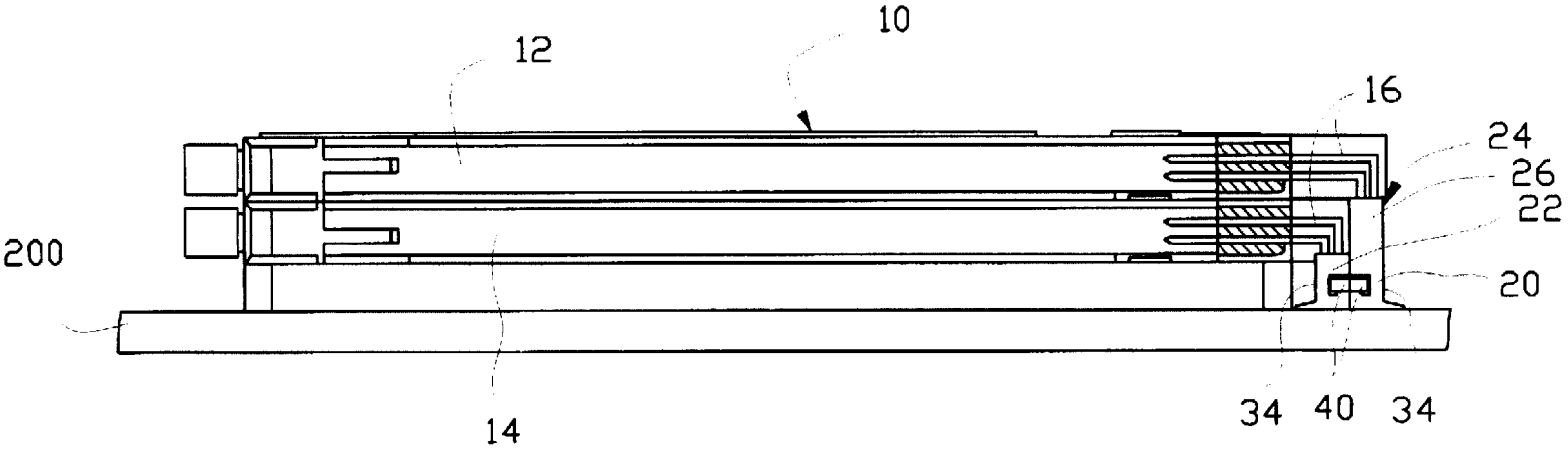
FIG. 5 is a partially cross-sectional view of another embodiment of an interface device for use with the stacked memory card connector assembly.

FIG. 5 is another embodiment of the interface device 24 wherein the first half section 20 is taller than the second half section 22 so that the contact tails 16 of the upper connector 12 can be more protectively shielded by the housing 26 of the first half section 22.

Figure 6:
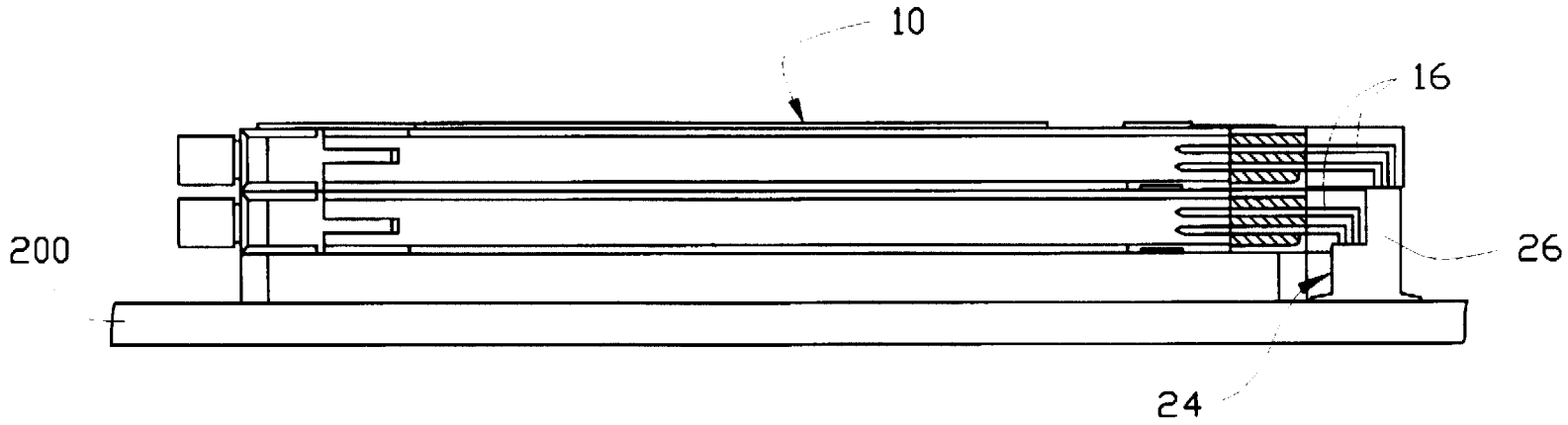
FIG. 6 is a partially cross-sectional view of another embodiment of an interface device for use with the stacked memory card connector assembly.

FIG. 6 is another embodiment of the interface device 24 wherein the housing 26 of the first half section 20 and the housing 26 of the second half section 22 of FIG. 5 are integrally formed as one piece.

Figure 7:
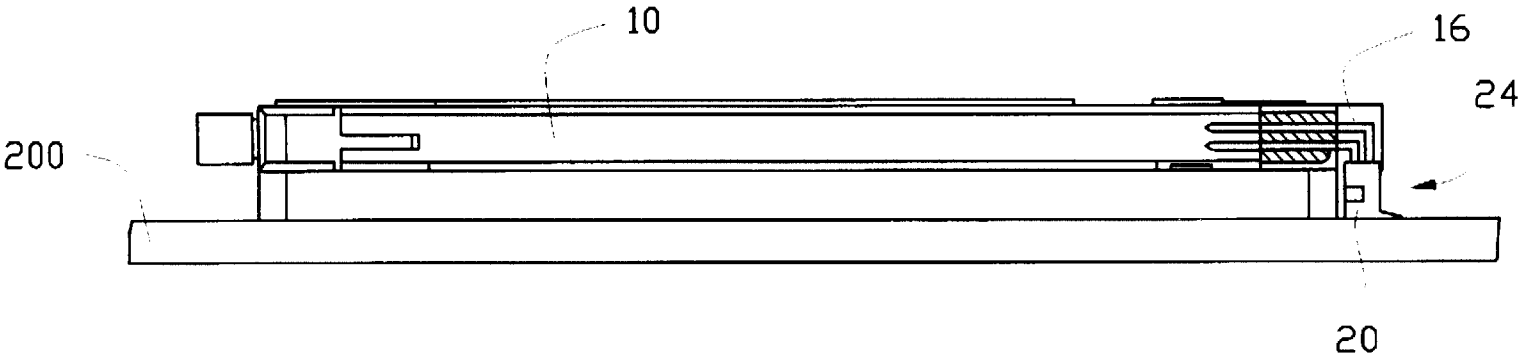
FIG. 7 is a partially cross-sectional view of another embodiment of an interface device for use with a single memory card connector.

FIG. 7 is another embodiment of the interface device 24 wherein only first half section 20 is used with the single memory card connector.

Figure 8:
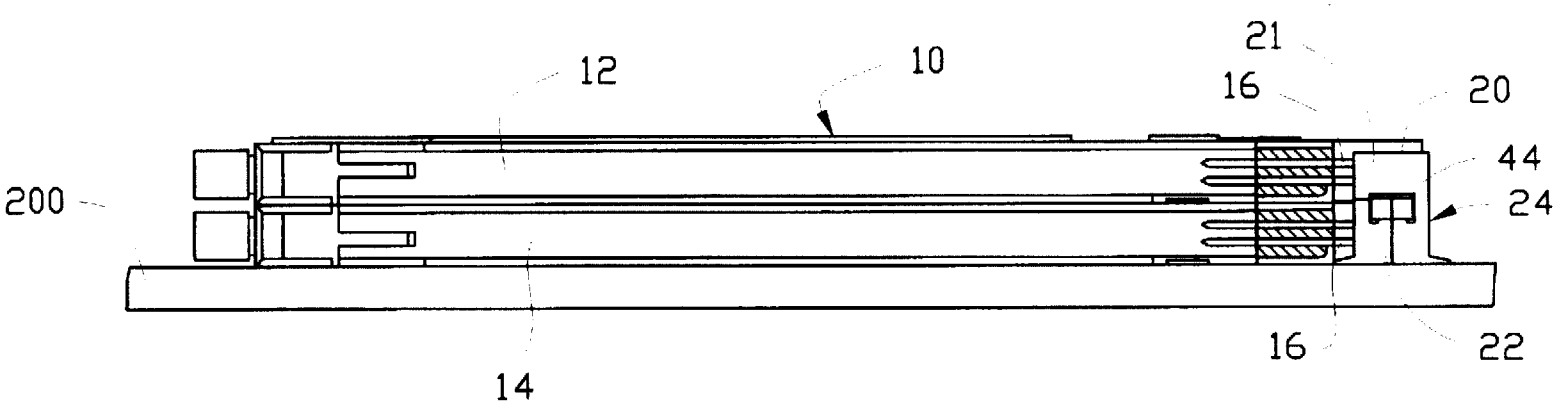
FIG. 8 is a partially cross-sectional view of another embodiment of an interface device for use with the stacked memory card connector assembly.

FIG. 8 shows another embodiment of the interface device 24 wherein the first half section 20 is not identical to the second half section 22 but is much larger than the second half section 22. It can be understood that the interface device 24 of the first embodiment is used for the stacked memory card connectors assembly 10 having right angle contact tails 16, and the passageways 30 in the housing 26 extend vertically therethrough; while in this embodiment, the contact tails 16 are of a straight form which is easy to fabricate, and the passageways (30) in the housing 26 extend horizontally therethrough.

Figure 9:
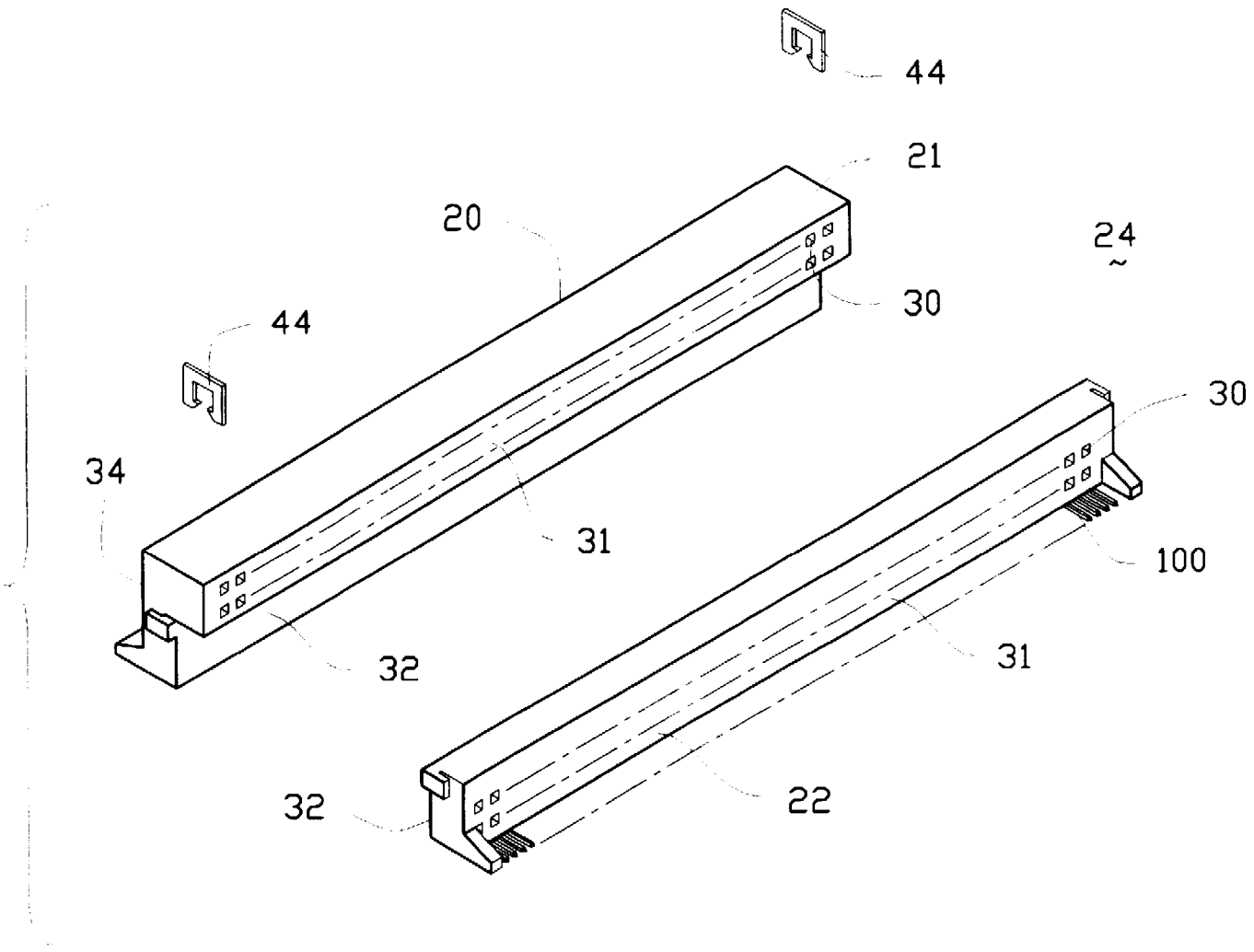
FIG. 9 is an exploded view of the interface device of FIG. 8.

Referring to FIGS. 8 and 9, the first half section 20 includes a raised projection portion 21 which is substantially positioned on the second half section 22 and includes a plurality of passageways 30 extending horizontally from the mating surface 31. Similar to the first embodiment, each passageway 30 includes a conductor 100 for engagement with the inserted contact tails 16 of the upper connector 12 and for solderably mounting to the mother board 200. Similarly, the second half section 22 also includes a plurality of passageways 30 extending inward from the mating surface 31 thereof for receiving a corresponding number of conductors 100 for cooperation with the inserted contact tails 16 of the lower memory card connector 14. The fastening between the first half section 12 and the second half section 14 are same as that in the first embodiment by the clips 44.

Figure 10:
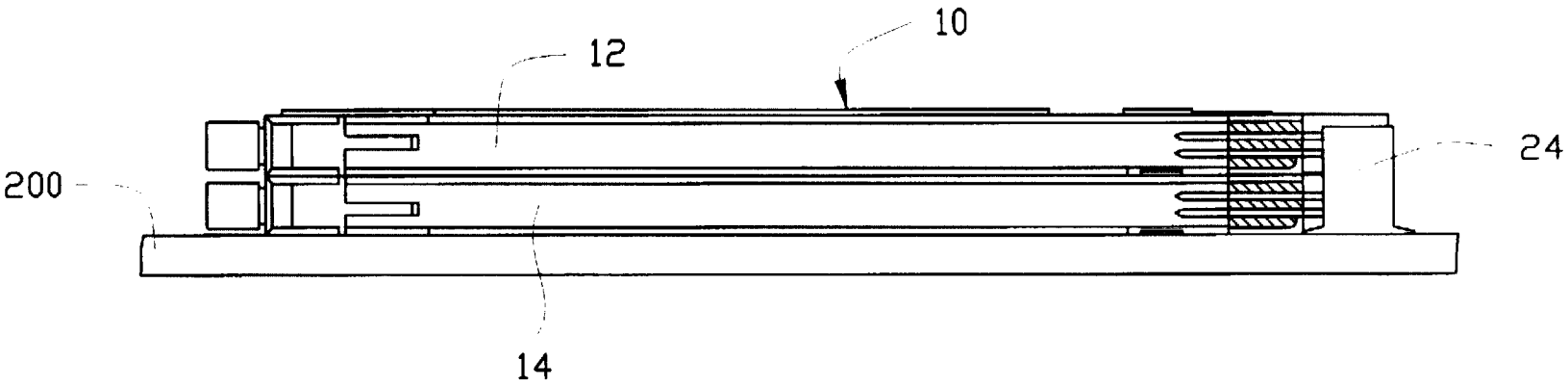
FIG. 10 is a partially cross-sectional view of another embodiment of an interface device for use with the stacked memory card connector assembly.

FIG. 10 discloses another embodiment of the interface device for use with the stacked memory card connector assembly 10 wherein the first half section 20 and the second half section 22 of the device 24 are integrally formed as one piece.

In comparison with the first embodiment and this embodiment, other than the contact tails have different configurations, i.e., one group of right angle type and another group of straight type, the height of the interface device in this embodiment is as tall as the stacked memory card connector assemble 10 and is almost three time over that in the first embodiment. In other words, the latter provides a better shielding protection for the contact tails 16 of the stacked memory card connector assembly 10 than the former.

Figure 11A:
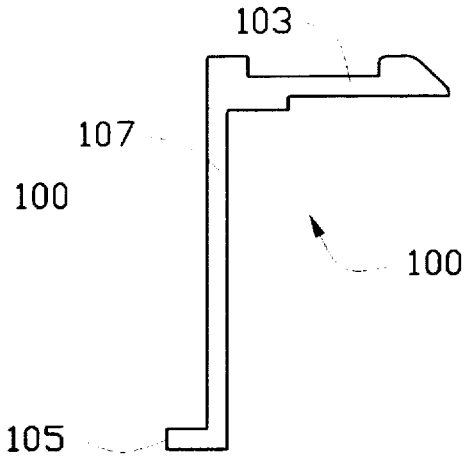
FIG. 11(A) is a plan view of the lower row conductor of the first half housing.
Figure 11B:
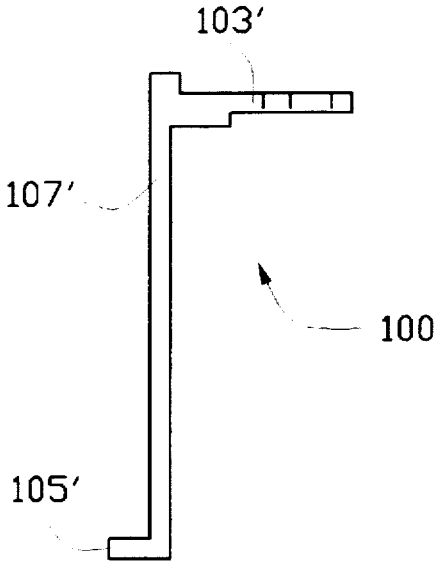
FIG. 11(B) is a plane view of the upper row conductor of the first half housing.
Figure 11C:
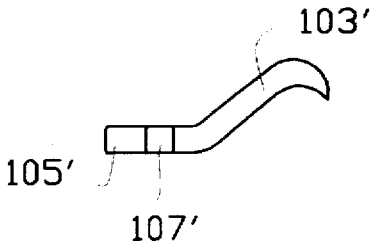
FIG. 11(C) is a top view of the upper row conductor of FIG. 11(B).

It should be appreciated that in this embodiment, the conductors 100 in the housing 26 of the first half section 20 and of the second half section 22 are of different shapes. For example, FIG. 11(A) shows the lower row conductor 100 of the first half section 20, wherein such conductor 100 generally is in a form of plate having a mating section 103 for engagement with the inserted contact tails 16 of lower row of the upper connector 12, a soldering section 105 for solderably mounting to the mother board 200, and an intermediate section 107 connected therebetween which is embedded within a corresponding vertical slot (not shown) in the exterior surface of the housing 26 of the first half section 20. FIG. 11(B) shows the upper row conductor 100 of the first half section 20 which also includes the soldering section 105', the mating section 103' and the intermediate section 107' therebetween wherein the intermediate section 107' is higher than that of the lower row conductor 100, and the mating section 103' is offset in a lateral direction (also referring to FIG. 11(C)). This is the reason why the two-row conductors of the first half section 20 can result in their soldering sections 107, 107' in a single straight line along the area A defined between two supporting piers 36 formed on two opposite ends of the housing 26.

Figure 12A:
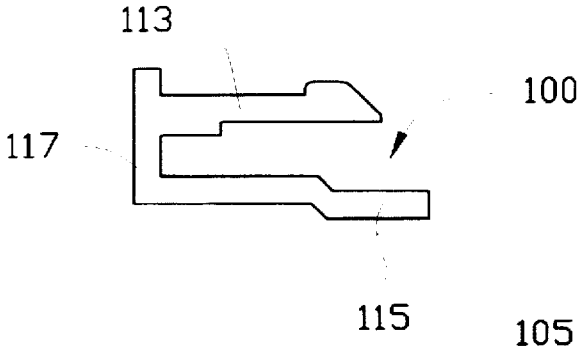
FIG. 12(A) is a plan view of the lower row conductor of the second half housing.
Figure 12B:
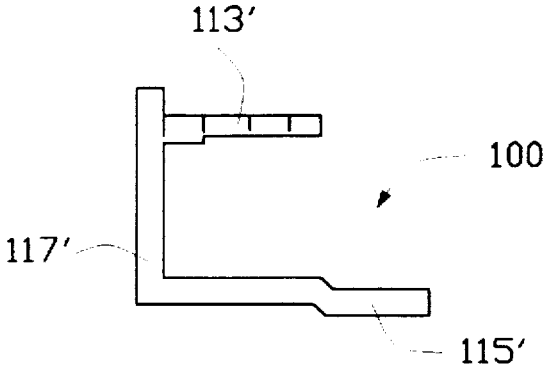
FIG. 12(B) is a plan view of the upper row conductor of the second half housing.
Figure 12C:
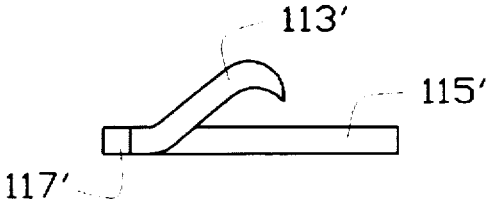
FIG. 12(C) is a top view of the upper row conductor of FIG. 12(B).

Similarly, referring to FIGS. 12(A)–12(C), the conductor 100 of the lower row of the second half section 22 also includes the mating section 113, the soldering section 115 and the intermediate section 117, and the conductor 100 of the upper row of the second half section 22 includes the mating section 113', the soldering section 115' and the intermediate section 117' wherein similar to the conductors 100 in the first half section 20, the intermediate section 117' of the upper row conductor 100 is longer than that of the lower row, and the mating section 113' of the upper row conductor 100 is offset in the lateral direction. The significant differences between the conductors 100 of the first half section 20 and of the second half section 22 are that the intermediate section 117 and 117' of the conductor 100 of the second half section 22 are embedded within the corresponding slots (not shown) adjacent the abutting surface 32 of the second half section 22, and that are different from those in the first half section 20, and the mating section 113, 113' and the soldering section 115, 115' horizontally extend in the same direction, not like those in the first half section 20 where the mating section 103, 103' and the soldering section 105, 105' extend in the opposite directions regard to the vertical intermediate section 107, 107'.

The feature of the invention is to provide a interface device which is of a compact size and can cooperate with the stacked memory card connector assembly whereby none of the contact tails of the memory card connectors need to be permanently soldered onto the mother board, thus avoid possible waste by discarding the unworkable expensive memory card connector if any direct soldering defect of the memory card connector on the mother board 200 occurs.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An assembly of a first and second connector and an interface device, said connectors being stacked together and each having a number of contacts, said interface device connecting the connectors to a mother board and comprising:

a first half section including a first dielectric housing having a first mating surface through which the contacts of the first connector extend into the first housing, a first mounting face adapted for connecting with the mother board, a plurality of first passageways defined from the first mating surface to the first mounting surface, a first abutting surface and a first side opposite the first abutting surface, and a number of first conductors received in the first passageways for electrically connecting with the contacts of the first connector and having first tail portions adapted to be soldered to the mother board and extending out of the first housing from the first side thereof; and a second half section connected with the first half section and including a second dielectric housing having a second mating surface through which the contacts of the second connector extend into the second housing, a second mounting face adapted for connecting with the mother board, a second abutting surface connecting with the first abutting surface of the first housing of the first half section and a second side opposite the second abutting surface, a plurality of second passageways defined from the second mating surface to the second mounting surface, and a number of second conductors received in the second passageways for electrically connecting with the contacts of the second connector and having second tail portions adapted to be soldered to the mother board and extending out of the second housing from the second side thereof.

2. The assembly in accordance with claim 1, wherein the first connector is located above the second connector and the second half section is located between the connectors and the first half section.

3. The assembly as defined in claim 1 further comprising a clip and locking bars formed on the first and second housings of the first and second half sections, respectively, wherein, the first half section and the second half section are secured to each other by the clip engaging the locking bars.

4. The assembly as defined in claim 1, wherein the first passageways extend vertically in the first housing of the first half section, and the first mating surface is a top surface of the first housing.

5. The assembly as defined in claim 1, wherein the first half section is generally identical to the second half section.

6. The assembly as defined in claim 1, wherein the first half section is substantially larger than the second half section.

7. The assembly as defined in claim 1, wherein the first passageways extend horizontally.

8. The assembly as defined in claim 7, wherein each of the conductors includes a mating section, a soldering section and an intermediate section.

9. The assembly as defined in claim 8, wherein some of the mating sections and soldering sections horizontally extend in opposite directions, and the other mating sections and soldering sections horizontally extend in a same direction.

10. The assembly as defined in claim 1, wherein said first half section and said second half section are integrally formed as one piece.

11. The assembly as defined in claim 2 further comprising a standoff provided on a bottom portion of the second connector.

12. An interconnection system including a stackable connector and an auxiliary interface device for connecting the connector to a mother board, said connector comprising a plurality of contacts arranged in a number of rows and having contact tails extending into the auxiliary interface device, said auxiliary interface device including at least an insulative housing having a first side near the connector and a second side opposite the first side and defining a plurality of passageways arranged in a number of rows, and a number of conductors received in the passageways and in electrical connection with the contact tails of the contacts of the connector, said conductors having tails adapted for electrically connecting with the mother board, arranged in a single line and commonly extending out of the housing of the auxiliary interface device from the second side thereof for providing easy access from an exterior.

13. The interconnection system as defined in claim 12, wherein said second side further includes a pair of supporting/protecting piers on two opposite ends thereof, the tails of the conductors extending between the two piers whereby the tails of the conductors are shielded by the piers.

* * * * *